US005458326A

United States Patent [19]

Marcyes

[11] Patent Number: 5,458,326

[45] Date of Patent: Oct. 17, 1995

[54] BATTING PRACTICE APPARATUS

[76] Inventor: Kevin W. Marcyes, 1796 Wyrick Ave., San Jose, Calif. 95124

[21] Appl. No.: 150,873

[22] Filed: Nov. 12, 1993

[51] Int. Cl.[6] ..... A63B 69/38

[52] U.S. Cl. ..... 273/26 E; 273/29 A; 273/58 C

[58] Field of Search ..... 273/26 R, 29 A, 273/26 E, 413, 58 C, 414

[56] References Cited

U.S. PATENT DOCUMENTS

| | | | |
|---|---|---|---|
| 708,573 | 9/1902 | Miles | 273/29 A |
| 831,605 | 9/1906 | Doyle | 273/26 E |
| 1,554,409 | 9/1925 | Coffee | 273/26 E |
| 3,623,725 | 11/1971 | Setten | 273/26 E |
| 3,825,259 | 7/1974 | Burchett | 273/26 E |
| 4,322,075 | 3/1982 | Hynes | 273/26 E |
| 4,632,394 | 12/1986 | Ryan | 273/26 E |
| 4,735,413 | 4/1988 | Yamanouchi et al. | 273/29 A |
| 4,867,448 | 9/1989 | Judd | 273/26 E |
| 4,966,367 | 10/1990 | Oyarzabal | 273/29 A |
| 5,040,791 | 8/1991 | Ratajac | 273/26 E |
| 5,056,784 | 10/1991 | Craig | 273/26 R |
| 5,072,937 | 12/1991 | Zarate | 273/58 C |

*Primary Examiner*—Theatrice Brown
*Attorney, Agent, or Firm*—Jack M. Wiseman

[57] ABSTRACT

A batting practice apparatus that employs a cyclone fence as an upright, rigid support. A rigid, horizontal arm is detachably secured at one end to the top of the fence. At the other end of the horiziontal arm is detachably secured the upper end of a vertically extending shock cord. At the other end of the shock cord is attached an anchoring spike. Intermediate the ends of the shock cord is a ball. The shock cord passes freely through the ball along its vertical axis. A tether passes horizontally through the ball at a location confronting the fence. Opposite ends of the tether are removably secured to the fence to form a triangle for adjusting the horizontal location of the ball. While the tether is detached from the fence at either end, the ball is movable along the shock cord to a desired height. When the tether is attached to the fence at each end in a taut state, the ball is maintained at the adjusted height along the shock cord.

10 Claims, 2 Drawing Sheets

BATTING PRACTICE APPARATUS

BACKGROUND OF THE INVENTION

The present invention relates in general to batting practice apparatus and, more particularly, to a batting practice apparatus that is portable when dismantled from an upright, generally rigid support.

The patent to Ratajac et al., U.S. Pat. No. 5,040,791, granted on Aug. 20, 1991, for Batting Cage, discloses a batting cage having an upper triangular frame and a lower triangular frame. The triangular frames are disposed in parallel relation. Interconnecting the upper and lower frames along the base of the respective triangular frames is an upright triangular frame. A shock cord extends generally vertical between the outermost ends of the upper and lower frames. Intermediate the ends of the shock cord is a ball. The shock cord extends through the vertical axis of the ball. The ball is fixedly secured to the shock cord. The height of the ball is varied by moving the location of the upper end of the shock cord along the upper triangular frame. A tether is attached at the opposite ends thereof to opposite sides, respectively, of the upright frame.

In the patent to Judd, U.S. Pat. No. 4,867,448, granted on Sep. 19, 1989, for Baseball Batting Practice Device, there is disclosed a device which allows a ball to be hit by a bat. The ball is suspended from a solid overhead object by an elastic member. The elastic member is attached at the bottom to a relatively solid positioner, which retains the ball for hitting on the same vertical axis after being struck by a bat.

In the patent to Hynes, U.S. Pat. No. 4,322,075, granted on Mar. 30, 1982, for Batting Practice Device, there is disclosed a batting practice device in which the height of the ball is adjusted by either adjusting the height of a horizontal support along a vertical support or by adjusting the height of the vertical support.

The patent to Craig, U.S. Pat. No. 5,056,784, granted on Oct. 15, 1991, for Athletic Swing Training Device, discloses a batting practice device which is attachable to a vertical object. Extending between the free ends of vertically spaced, horizontal supports is a shock cord. Intermediate the ends of the shock cord is a ball. The ball is movable along the shock cord to adjust the height of the ball.

In the patent to Yamanouchi et al. U.S. Pat. No. 4,735,413, granted on Apr. 5, 1988, there is disclosed a Tennis Practice Apparatus in which a ball is movable along a generally vertical first elastic string. The first elastic string is attached to its lower end to a guide rope. A second elastic string is stretched in parallel relation to the first elastic string. The second elastic string passes through the ball in a generally vertical direction and is secured to the ball. The second elastic string supports the ball and facilitates control over the height of the ball.

SUMMARY OF THE INVENTION

Briefly described, a batting practice apparatus comprises a horizontal upper rigid support member that is secured at one end to an upright, generally rigid support. At the other end of the horizontal support member is attached the upper end of a vertically extending shock cord. The opposite end of the vertically extending shock cord is anchored to a support surface. Intermediate the ends of the shock cord is a ball suitable for batting practice. The shock cord passes freely through the ball along its vertical axis. A tether passes generally horizontally through the ball at a location confronting the upright rigid support. Opposite ends of the tether are removably secured to the upright rigid support to form a triangle with the upright rigid support. While the tether is detached from the upright, rigid support at either end thereof, the ball is adjustably movable along the shock cord to a desired height. When the tether is attached to the upright rigid support at each end in a taut state, the ball is maintained at the adjusted height along the shock cord. The ball is also adjustable for horizontal location by varying the location of the free ends of the tether along the upright, rigid support.

An object of the present invention is to provide a batting practice apparatus that is easily and quickly installed to and dismantled from a fence.

A feature of the present invention is that a user hits the ball with an athletic device, such as a bat, the ball after impact displacement returns to its initial position for further batting practice.

Another feature of the present invention is that the batting practice apparatus, when removed from an upright, rigid support, such as a fence, lends itself for packing in a bag to be transported in a compact fashion.

Another feature of the present invention is the height adjustment of a ball along a shock cord and the ball is maintained at the adjusted height by a tether passing horizontally through the ball. The tether is secured at its free ends to an upright, generally rigid support to maintain the ball at its adjusted height when the tether is in a taut state.

Another feature of the present invention is the anchoring of the shock cord at its lower end in the ground by driving a spike into the ground.

Another feature of the present invention is the adjustment of the horizontal location of the ball by varying the location of the free ends of the tether along an upright, rigid support.

DETAILED DESCRIPTION OF THE PREFERRED EMBODIMENT

Figure 1:
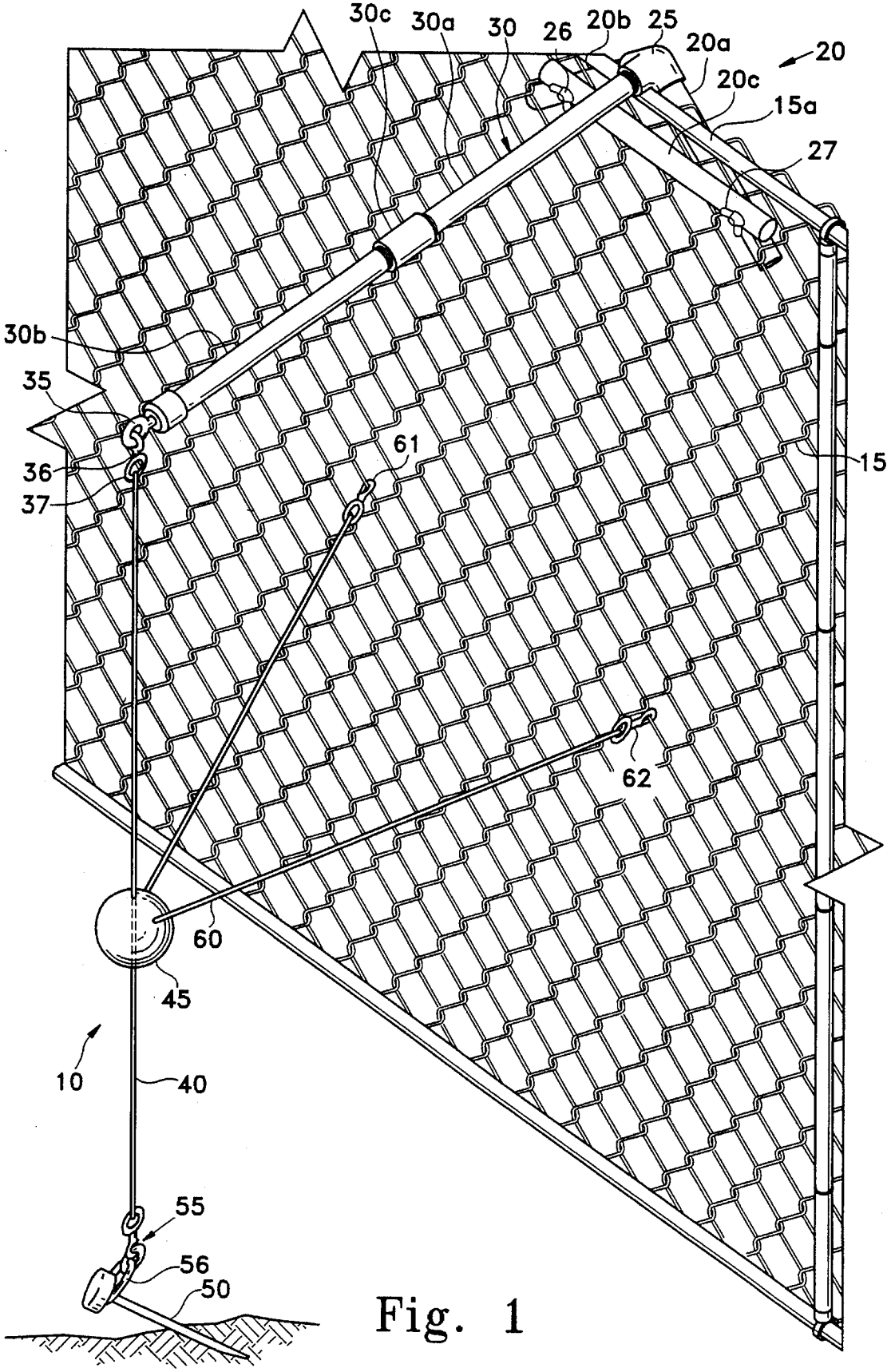
FIG. 1 is a perspective view of the batting practice apparatus of the present invention.
Figure 2:
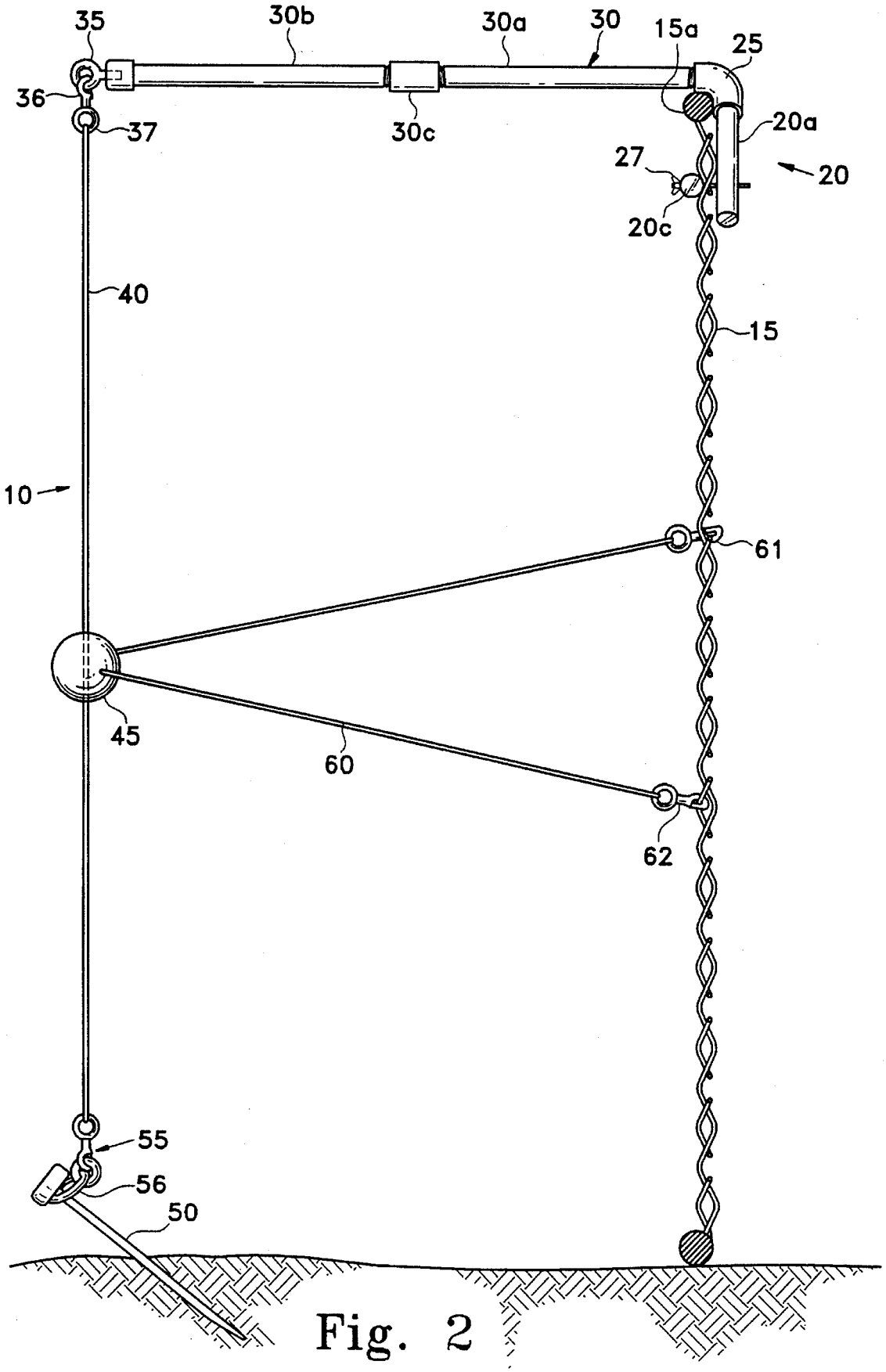
FIG. 2 is an elevation view of the batting practice apparatus shown in FIG. 1.

Illustrated in FIGS. 1 and 2 is the batting practice apparatus 10 embodying the present invention. The batting practice apparatus 10 comprises an upright, generally rigid support 15 to which a support frame 20 is attached. In the preferred embodiment, the upright, rigid support 15 is an upright fence, such as a cyclone fence.

The support frame 20, in the exemplary embodiment, has a triangular configuration and comprises suitable rigid members 20*a*–20*c*. The base member 20*c* of the frame 20 is disposed on the inner side of the upright, rigid support 15, while the leg members 20*a* and 20*b* of the frame 20 are disposed along the outer side of the upright, rigid support 15. Wing nuts or clamps 26 and 27, which are on the inner side of the upright, rigid support 15, releasably secure the base member 20*c* to the leg members 20*a* and 20*b* so as to enable the frame 20 to be attached to the rigid support 15 or to be removed from the rigid support 15. The upright rigid support 15 is sandwiched between the base member 30*c*, on the one hand, and the legs 20*a* and 20*b*, on the other hand.

A coupling 25 with three internally threaded openings is supported by and seats on a rigid, horizontal member 15*a* at the top of the upright, rigid support 15. A horizontal, rigid support member 30 includes two sections 30*a* and 30*b* joined at confronting ends by a threaded coupling 30*c*. The horizontal, rigid support member 30, through the free end of the section 30*a* thereof, is threaded to the wall surrounding one internally threaded opening of the coupling 25. The leg member 20*a* is threaded to the wall surrounding a second internal threaded opening of the coupling 25. The leg member 20*b* is threaded to a wall surrounding the third internally threaded opening of the coupling 25. A plane passing through the axes of the leg members 20*a* and 20*b* is a right angle to the axis of the horizontal, rigid support member 30.

At the free end of the section 30*b* of the horizontal, rigid support member 30 is secured a loop or ring 35. Detachably connected to the loop 35 is a suitable fastener, such as a well-known snap-spring swivel hook 36 that has a loop or ring 37 fixed thereto. Attached to the ring 37 is one end of a shock cord 40. The shock cord 40 passes freely through the vertical axis of a suitable hitting object, such as a ball 45, which ball 45 is suitable for batting practice. In the exemplary embodiment, the ball 45 is made of solid styrene.

The other end of the shock cord 40 is connected to a suitable anchor, such as spike 50, through suitable linkage 55. The linkage 55 includes a loop 56 that receives the shaft of the spike 50 and is freely disposed below the head of the spike 50. Driving the spike 50 into the ground releasably secures the other end of the shock cord 40 to the ground.

The ball 45 is freely movable along the shock cord 40 for adjustably positioning the height of the ball 45 along the shock cord 50. In order to maintain the ball 45 at its adjusted height during batting practice, a tether 60 is provided. The tether 60 passes through the ball 45 generally horizontally at a location preferably confronting the upright, rigid support 15. Opposite ends of the tether 60 are respectively removably secured to the upright, rigid support 15 by suitable fasteners, such as snap-spring, swivel hooks 61 and 62. The tether 60 and the portion of the upright, rigid support member 15 to which the tether 60 is attached form a triangle.

While the tether 60 is detached from the upright, rigid support 15 at either end thereof, or at both ends thereof, the ball 45 is adjustably movable along the shock cord 40 to a desired height for batting practice. When the tether 60 is attached to the upright, rigid support 15 at each end thereof in a taut state, the ball 45 is maintained at the adjusted height along the shock cord 40. The ball 45 is also adjustable for horizontal location by varying the position of the free ends of the tether 60 along the upright, rigid support 15.

A user hits the object 45, such as a ball, with a suitable athletic device, such as a bat, for batting practice. After impact displacement, the ball 45 returns to its initial position for further batting practice.

What is claimed is:

1. A batting practice apparatus comprising:

(a) an upright, generally rigid support;

(b) a rigid, horizontal support attached to said upright, rigid support at one end thereof, the other end of said rigid, horizontal support being a free end;

(c) a vertical shock cord connected at one end to the free end of said rigid, horizontal support and anchored at the other end thereof;

(d) a batting practice object having a vertical axis, said shock cord being freely received by said batting practice object along the vertical axis thereof for adjusting the height of said batting practice object along said shock cord, said batting practice object being freely movable along said shock cord to adjust the height of said batting practice object along said shock cord; and (e) a tether connected at its ends to said upright, rigid support, said tether being freely received by said batting practice object in a generally horizontal direction, said batting practice object being freely movable along said tether, said batting practice object being maintained at the adjusted height along said shock cord in response to said tether being in a taut state, said batting practice object being adjustably positioned along said shock cord in response to said tether being in a loosened state.

2. A batting practice apparatus as claimed in claim 1 wherein said upright, rigid support is a fence.

3. A batting practice apparatus as claimed in claim 2 and comprising a spike connected to said other end of said shock cord and driven into a support surface for anchoring said other end of said shock cord.

4. A batting practice apparatus as claimed in claim 1 and comprising a spike connected to said other end of said shock cord and driven into a support surface for anchoring said other end of said shock cord.

5. A batting practice apparatus as claimed in claim 1 wherein said tether and the upright, rigid support to which said free ends of said tether are connected in spaced relation form a triangle for adjusting the horizontal location of said batting practice object.

6. A batting practice apparatus comprising:

(a) an upright, generally rigid support;

(b) a rigid, horizontal support detachably secured to said upright, rigid support at one end thereof, the other end of said rigid, horizontal support being a free end;

(c) a vertical shock cord detachably connected to the free end of said rigid, horizontal support and detachably anchored at the other end thereof;

(d) a batting practice object having a vertical axis, said shock cord being freely received by said batting practice object along the vertical axis thereof for adjusting the height of said batting practice object along said shock cord, said batting practice object being freely movable along said shock cord to adjust the height of said batting practice object along said shock cord; and (e) a tether releasably connected at its ends to said upright, rigid support, said tether being freely received by said batting practice object in a generally horizontal direction, said batting practice object being freely movable along said tether, said batting practice object being maintained at the adjusted height along said shock cord in response to said tether being in a taut state, said batting practice object being adjustably positioned along said shock cord in response to said tether being in a loosened state.

7. A batting practice apparatus as claimed in claim 6 wherein said upright, rigid support is a fence.

8. A batting practice apparatus as claimed in claim 7 and comprising a spike connected to the other end of said shock cord and driven into a support surface for releasably anchoring said other end of said shock cord.

9. A batting practice apparatus as claimed in claim 6 and comprising a spike connected to said other end of said shock cord and driven into a support surface for releasably anchoring said other end of said shock cord.

10. A batting practice apparatus as claimed in claim 6 wherein said tether and the upright, rigid support to which said free ends of said tether are detachably connected in spaced relation form a triangle for adjusting the horizontal location of said batting practice object.

* * * * *